US009814286B2

(12) United States Patent
Clawson

(10) Patent No.: US 9,814,286 B2
(45) Date of Patent: Nov. 14, 2017

(54) USER ASSEMBLED JEWELRY KIT

(71) Applicant: Cassidy Clawson, Santa Cruz, CA (US)

(72) Inventor: Cassidy Clawson, Santa Cruz, CA (US)

( * ) Notice: Subject to any disclaimer, the term of this patent is extended or adjusted under 35 U.S.C. 154(b) by 0 days.

(21) Appl. No.: 15/343,527

(22) Filed: Nov. 4, 2016

(65) Prior Publication Data

US 2017/0251773 A1 Sep. 7, 2017

Related U.S. Application Data

(60) Provisional application No. 62/304,298, filed on Mar. 6, 2016, provisional application No. 62/366,077, filed on Jul. 24, 2016.

(51) Int. Cl.

| | |
|---|---|
| ***A44C 7/00*** | (2006.01) |
| ***A44C 15/00*** | (2006.01) |
| *A44C 27/00* | (2006.01) |

(52) U.S. Cl.

CPC ..... *A44C 7/002* (2013.01); *A44C 15/003* (2013.01); *A44C 27/00* (2013.01)

(58) Field of Classification Search

CPC ..... A44C 25/00; A44C 25/001; A44C 27/00; A44C 7/00; A44C 7/002; A44C 15/003

USPC ..... 206/6.1; 428/542.6

See application file for complete search history.

(56) References Cited

U.S. PATENT DOCUMENTS

| | | | | |
|---|---|---|---|---|
| 2,424,047 | A | 7/1947 | Morin | |
| 2,680,344 | A | 6/1954 | Capellazzi et al. | |
| 2,936,600 | A | 5/1960 | Crigler | |
| 3,533,247 | A * | 10/1970 | Douglas | A44C 7/002 63/13 |
| 3,732,134 | A * | 5/1973 | Michael | A44C 15/00 156/230 |
| 4,974,430 | A | 12/1990 | Turner | |
| 5,032,437 | A | 7/1991 | Tourlentes | |
| 7,563,340 | B2 | 7/2009 | Peterson | |
| 8,910,496 | B2 | 12/2014 | Monahan | |
| 9,217,996 | B2 | 12/2015 | Saarela et al. | |
| 2005/0103051 | A1* | 5/2005 | Jacquin | A44C 25/00 63/33 |
| 2012/0240623 | A1 | 9/2012 | Morse | |
| 2012/0324948 | A1* | 12/2012 | Harbarenko | A44C 25/001 63/12 |

OTHER PUBLICATIONS

Loving Warm Home; 50Pcs Wedding Party Label Price Gift Cards Glass Tags Romantic Butterfly Hollow Shape craft Paper Hang Tag Decoration Bookmark; Internet Merchandise; 2013; AliExpress; Available at http://www.aliexpress.com/item/50Pcs-Wedding-Party-Label-Price-Gift-Cards-Glass-Tags-Romantic-Butterfly-Hollow-Shape-Craft-Paper-Hang/32645545890.html?spm=2114.40010308.4.72.7CAKLX.

(Continued)

*Primary Examiner* — Emily M Morgan

(74) *Attorney, Agent, or Firm* — Hankin Patent Law, APC; Anooj Patel; Kevin Schraven

(57) ABSTRACT

A jewelry kit, comprising: a card; two pendants; two pockets and two earwires. The pendants may be removeably secured to the card by one or more pre-formed guides. Each of the two pockets is configured to removeably secure one of the two earwires. After the two pendants and the two earwires are removed from the card, the two pendants are configured to be connected to the two earwires and then worn by a user.

17 Claims, 9 Drawing Sheets

(56) References Cited

OTHER PUBLICATIONS

Comeuppance; Personalised laser cut love birds; Internet Merchandise; 2009; Etsy; Available at https://www.etsy.com/es/listing/115514531/personalised-laser-cut-love-birds?ref=shop_home_active.
Beading Gem; 3D Laser Cut Paper Jewelry—Paper Couture; Internet Merchandise; Nov. 2008; Available at http://www.beadinggem.com/2008/11/3d-laser-cut-paper-jewelry-paper.html.
Effyharperco on ETSY; Red Monroe Paper Stamp Earrings; Internet Merchandise; 2015; Wanelo; Available at https://wanelo.co/store/effyharperco.
Tithi Kutchamuch and Nutre Arayavanish; Pop-Out Paper Jewelry; Article; Dec. 2008; TT:NT; Available at http://www.trendhunter.com/trends/fold-out-paper-jewelry-diy-floral-rings-for-every-month.
Mega Bead Store; 10 pcs 14KGold Filled Earwires Ball End Ear Wire F120GF; Internet Merchandise; 2007; Etsy; Available at https://www.etsy.com/listing/60495055/10-pcs-14kgold-filled-earwires-ball-end?ga_order=most_relevant&ga_search_type=all&ga_view_type=gallery&ga_search_query=&ref=sr_gallery_35.
Life Chilli; Paper Quilling Earrings Designs and Ideas; Interest Merchandise; 2013; Pinterest; Available at http://www.lifechilli.com/paper-quilling-earrings-designs-ideas/.
Stephanie Paxman; Paper Earrings; Internet Article; Apr. 2012; Crafting in the Rain; Available at http://www.craftingintherain.com/2012/04/paper-earrings.html.
Cathys Unique Creation; Black Friday Cyber Monday BULK Jewelry Sale, Wholesale, Laser Cut Earrings, Laser Cut Necklace, Laser Cut Pendants, Destash, Clearance, Sale; Internet Merchandise; 2009; Etsy; Available at https://www.etsy.com/listing/114654617/black-friday-cyber-monday-bulk-jewelry?utm_source=Pinterest&utm_medium=PageTools&utm_campaign=Share&pp=0.
Sarah Louise Jay; Beautiful Laser Cut Jewelry; Internet Merchandise; Aug. 2013; The Wallbreakers; Available at http://thewallbreakers.com/beautiful-laser-cut-jewelry-from-sarah-louise-jay/#sthash.WKIgiWq7.qjtu.

* cited by examiner

USER ASSEMBLED JEWELRY KIT

CROSS-REFERENCE TO RELATED APPLICATIONS

This Non-Provisional Patent Application claims the benefit of U.S. Provisional Patent Application Nos. 62/304,298, filed on Mar. 6, 2016, titled "COSTUME JEWELRY MANUFACTURED OF CUT AND PRINTED SHEET MATERIAL," by inventor Cassidy Clawson; and 62/366,077, filed on Jul. 24, 2016, titled "SPRING LOCKING EARWIRE TO FACILITATE CUSTOMER ASSEMBLY OF EARRINGS," by inventor Cassidy Clawson, the contents of which are expressly incorporated herein by this reference as though set forth in their entirety.

FIELD OF USE

The present disclosure relates generally to jewelry, and more particularly, to a disposable, user assembled jewelry kit, which allows a user to assemble their own jewelry from an all-in-one kit.

BACKGROUND

Jewelry and fashion accessories allow individuals to express themselves creatively. Earrings are a common type of jewelry. There has also been a rise in what is known as fast fashion, meaning fashion products that prioritize trendiness and affordability over durability and longevity. Fast fashion products are often discarded after a handful of uses.

Earrings are often constructed of precious metals and gemstones, which means the earrings themselves are generally expensive. This prevents most people from having numerous sets of earrings for different occasions. Additionally, while there does exist inexpensive jewelry, often referred to as costume jewelry, this inexpensive jewelry still occupies space and is not generally inexpensive enough to be considered one-time-use and disposable.

Because of the generally costly nature of jewelry, it is not practical for a user to purchase earrings for one-time-use, and therefore, users are less likely to have a multitude of earrings that can be used to match a particular outfit, particular mood or specific event.

Additionally, due to the nature of earrings being a set comprised of two separate pieces intended to be worn together, it is possible that a single earring may become lost, either in storage or elsewhere. Storing earrings also can take up space and not effectively ensure that the two pieces of matching earrings stay together for use at a later time.

Therefore, there is a need for a new and improved earring that takes up little to no storage space and allows for users to use the earrings as if they are disposable earrings.

SUMMARY OF EMBODIMENTS

To minimize the limitations in the prior art, and to minimize other limitations that will become apparent upon reading and understanding the present disclosure, the present specification discloses a new and improved piercing accessory and accessory system.

One embodiment may be a jewelry kit comprising: a card; and one or more pendants. The one or more pendants may be removeably secured to the card by one or more pre-formed guides and after the one or more pendants are removed from the card, the one or more pendants are configured to be worn by a user. Preferably the card may be substantially flat and rigid. The one or more pendants may be substantially flat and rigid. The card and the one or more pendants may be made of one or more materials selected from the group of materials consisting of: paper; cardboard; metal; and/or plastic. The one or more pendants and the card may be configured to be disposable. The one or more pre-formed guides may be selected from the group of guides consisting of: perforations; scoring lines; and die marks. The kit may further comprise: one or more earwires, which may be removeably secured to the card. The card may comprise one or more pockets, which may be configured to house the earwires before the earwires are removed from the card. The kit may further comprise one or more adhesive strips that may be configured to adhesively engage the earwires and removeably secure the earwires into the one or more pockets. The one or more pendants may comprise one or more earwire attachment holes, wherein each of the one or more earwire attachment holes may be configured to connect to at least one of the one or more earwires. After the one or more pendants are attached to the one or more earwires, the one or more earwires may be worn by the user.

Another embodiment may be a jewelry kit, comprising: a card; two pendants; and two earwires, wherein the pendants may be removeably secured to the card by one or more pre-formed guides. The card may comprise two pockets, wherein each of the two pockets may be configured to removeably secure one of the two earwires. After the two pendants and the two earwires are removed from the card, the two pendants may be configured to be connected to the two earwires and then worn by a user. The card and the two pendants may be substantially flat and rigid. The two earwires may have a thickness that is less than or equal to a thickness of the card. The card and the one or more pendants may be made of one or more materials selected from the group of materials consisting of: paper; cardboard; metal; and plastic. The one or more pre-formed guides may be selected from the group of guides consisting of: perforations; scoring lines; and die marks. The kit may further comprise one or more adhesive strips that are configured to adhesively engage the earwires and removeably secure the earwires into the one or more pockets. The one or more pendants may comprise one or more earwire attachment holes, wherein each of the one or more earwire attachment holes may be configured to connect to at least one of the one or more earwires. After the one or more pendants are attached to the one or more earwires, the one or more earwires may be worn by the user.

It is an object to provide an earring kit that is inexpensive and/or disposable.

It is an object to provide an earring kit that is uniquely marketed and may be assembled by a user.

It is an object to provide a way for users to have a multitude of different styled earrings available to allow a user to express themselves.

It is an object to provide a compact product.

It is an object to overcome the deficiencies of the prior art.

These, as well as other components, steps, features, objects, benefits, and advantages, will now become clear from a review of the following detailed description of illustrative embodiments, of the accompanying drawings, and of the claims.

BRIEF DESCRIPTION OF THE ILLUSTRATIVE EMBODIMENTS

The drawings show illustrative embodiments, but do not depict all embodiments. Other embodiments may be used in addition to or instead of the illustrative embodiments. Details that may be apparent or unnecessary may be omitted for the purpose of saving space or for more effective illustrations. Some embodiments may be practiced with additional components or steps and/or without some or all components or steps provided in the illustrations. When different drawings contain the same numeral, that numeral refers to the same or similar components or steps.

Figure 9A:
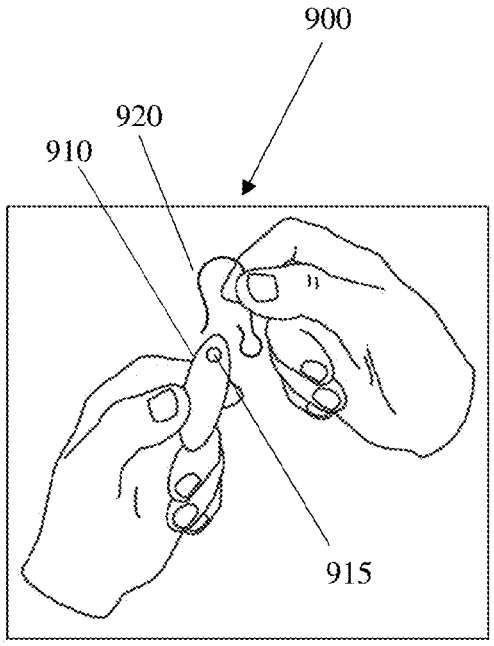
Figure 9B:
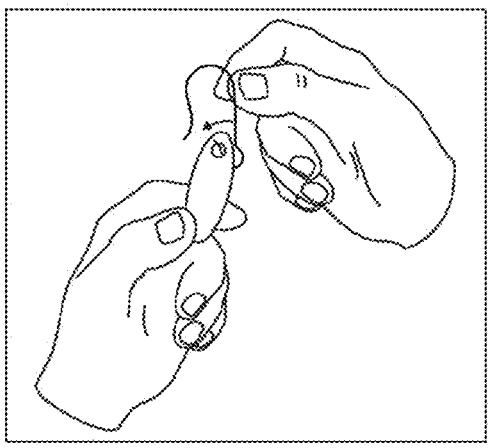
Figure 9C:
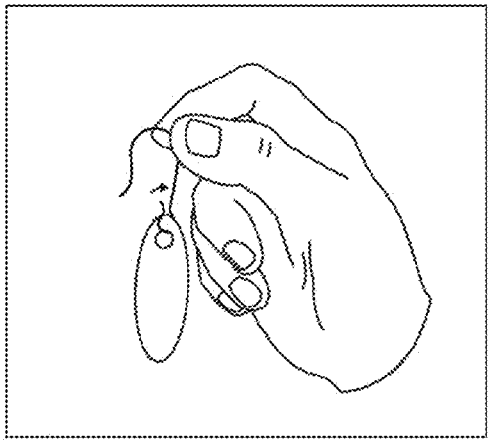

FIGS. 9*a-c* are illustrations showing the process for assembling earrings provided in the jewelry kit.

DETAILED DESCRIPTION OF THE ILLUSTRATIVE EMBODIMENTS

In the following detailed description of various embodiments, numerous specific details are set forth in order to provide a thorough understanding of various aspects of the embodiments. However, the embodiments may be practiced without some or all of these specific details. In other instances, well-known procedures and/or components have not been described in detail so as not to unnecessarily obscure aspects of the embodiments.

While some embodiments are disclosed here, other embodiments will become obvious to those skilled in the art as a result of the following detailed description. These embodiments are capable of modifications of various obvious aspects, all without departing from the spirit and scope of protection. The figures, and their detailed descriptions, are to be regarded as illustrative in nature and not restrictive. Also, the reference or non-reference to a particular embodiment shall not be interpreted to limit the scope of protection.

In the following description, certain terminology is used to describe certain features of one or more embodiments. For purposes of the specification, unless otherwise specified, the term "substantially" refers to the complete or nearly complete extent or degree of an action, characteristic, property, state, structure, item, or result. For example, in one embodiment, an object that is "substantially" located within a housing would mean that the object is either completely within a housing or nearly completely within a housing. The exact allowable degree of deviation from absolute completeness may in some cases depend on the specific context. However, generally speaking the nearness of completion will be so as to have the same overall result as if absolute and total completion were obtained. The use of "substantially" is also equally applicable when used in a negative connotation to refer to the complete or near complete lack of an action, characteristic, property, state, structure, item, or result.

Figure 1:
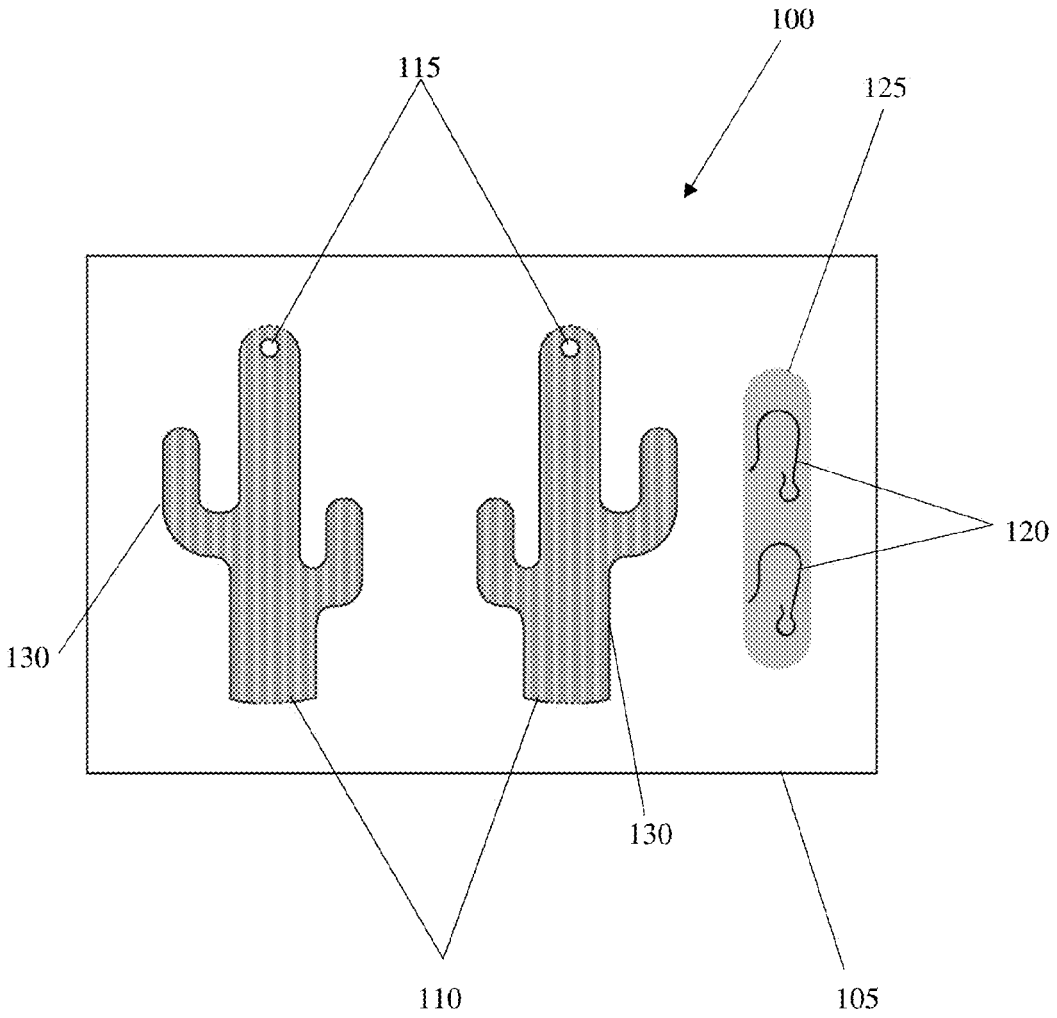
FIG. 1 is an illustration of a front view of one embodiment of the jewelry kit.

FIG. 1 is an illustration of a front view of one embodiment of the jewelry kit. As shown in FIG. 1, the jewelry kit 100 may comprise a card 105, pendants 110, pendant attachment portions 115, earwires 120, an earwire securement strip 125; and pre-formed guides 130. The card 100 may be substantially flat, and constructed from any thin material, such as paper, cardboard, metal sheets, plastic, or other substantially flat material. The card 100 may preferably be stiff and rigid, so as to protect the pendants 110 and earwires 120. In some embodiments the card 100 may be flexible or even bendable.

The pendants 110 may be mirror images of one another, such that when worn, the pendants 110 appear to be symmetrical. Alternatively, the pendants 110 may be identical or completely different shapes and colors, depending on the preferences of the user. The pendants 110 may be created as a result of the pre-formed guides 130. Specifically, the pre-formed guides 130 may be perforations, scores, notches, cuts, or other impressions made on the card 105. A user may then apply a pressure, such as by hand, against the pendants 110 to cause the pendants 110 to separate from the card 105 along the pre-formed guides 130. Alternatively, the pendants 110 may be torn, or even cut, out of the card 105 along the pre-formed guides. The pre-formed guides 130 may be created by the use of a die, stamp or cutting process. The die may be a physical die, laser die, or other mechanism for scoring, cutting, stamping, tearing, perforating, or otherwise physically marking the outline of the pendants 110. Additionally, the card 105 may have a design printed onto the card 105 such that the pre-formed guides 130 demarcate a shape that also has the color or pattern of a physical object, decorative ornamentation, or any other artistic representation. Accordingly, the pendants 110 may be substantially any shape or design desired. As shown in FIG. 1, the pendants 110 may be, for example, cactus shaped. The pendants 110 may be identical, matching, mirror images, unique, or any other combination of shapes. The pendants 110 may comprise pendant attachment portions 115. As shown in FIG. 1, the pendant attachment portions 115 may be holes in the pendants 110 capable of receiving a hook or other ear attaching structure. One such hook or other ear attaching structure may be the earwires 120.

The earwires 120 may be removeably fixed to the card 105. The earwire securement strip 125 may be used to removeably fix the earwires 120 to the card 105. The earwire securement strip 125 may be a translucent or opaque strip and may be adhesively, tearably, or otherwise secured to the card 105. A user may remove or tear away the earwire securement strip 125 to gain access to the earwires 120, which may then be removed from the card 105. The earwires 120 may be a structure capable of securing a pendant 110 on one end, and securing to a user's body piercing hole on another end. In one embodiment, the earwires 120 rest in an indentation in the card 105. In an alternative embodiment of the jewelry kit, the earwires 120 may be included in the packaging with the card 105 and not be included as a specific portion of the card 120 such as being included in a bag, packaging sleeve, or other packaging device.

Figure 2:
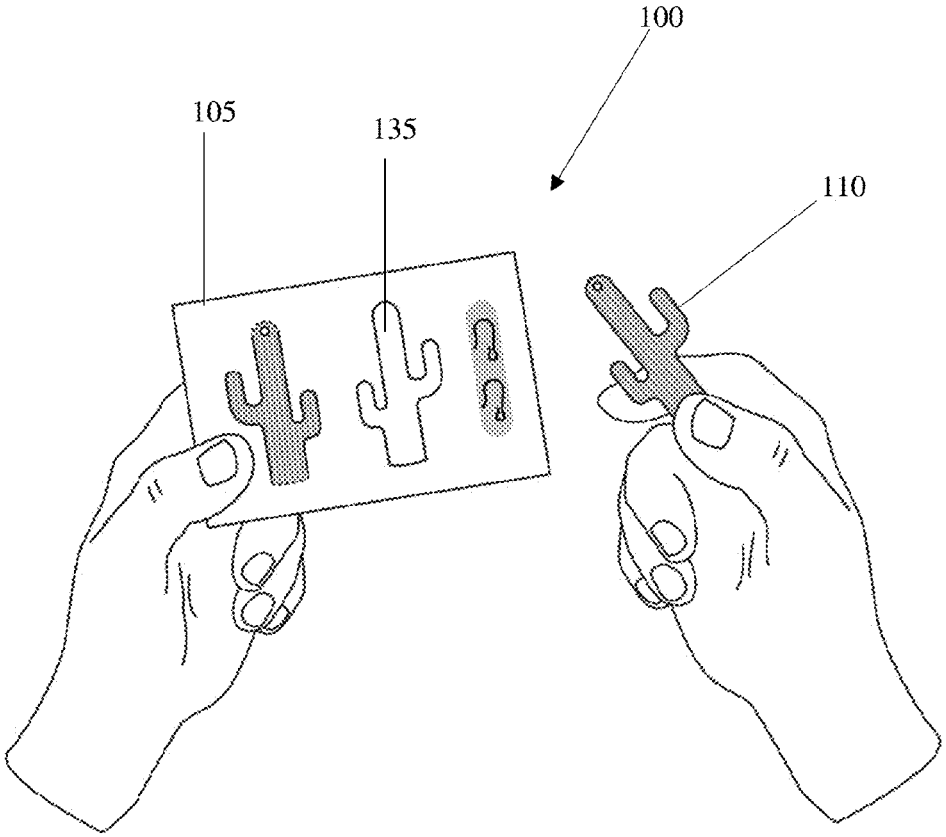
FIG. 2 is an illustration of one embodiment of the jewelry kit having one pendant separated.

FIG. 2 is an illustration of one embodiment of the jewelry kit having one pendant separated from the card. As shown in FIG. 2, the jewelry kit 100 may have pendants 110 that are separateable by hand from the card 105. After the pendant 110 has been separated, a pendant shaped hole 135 may be left in the card 105. In one embodiment of the invention, once the pendant 110 is removed from the card 105 the pendant 110 is not configured to be re-attached to the card 105. Rather than continuing to store the pendant, the user will typically throw it away. However, some embodiments of the kit may allow for the pendant to be re-attached to the card.

Figure 3:
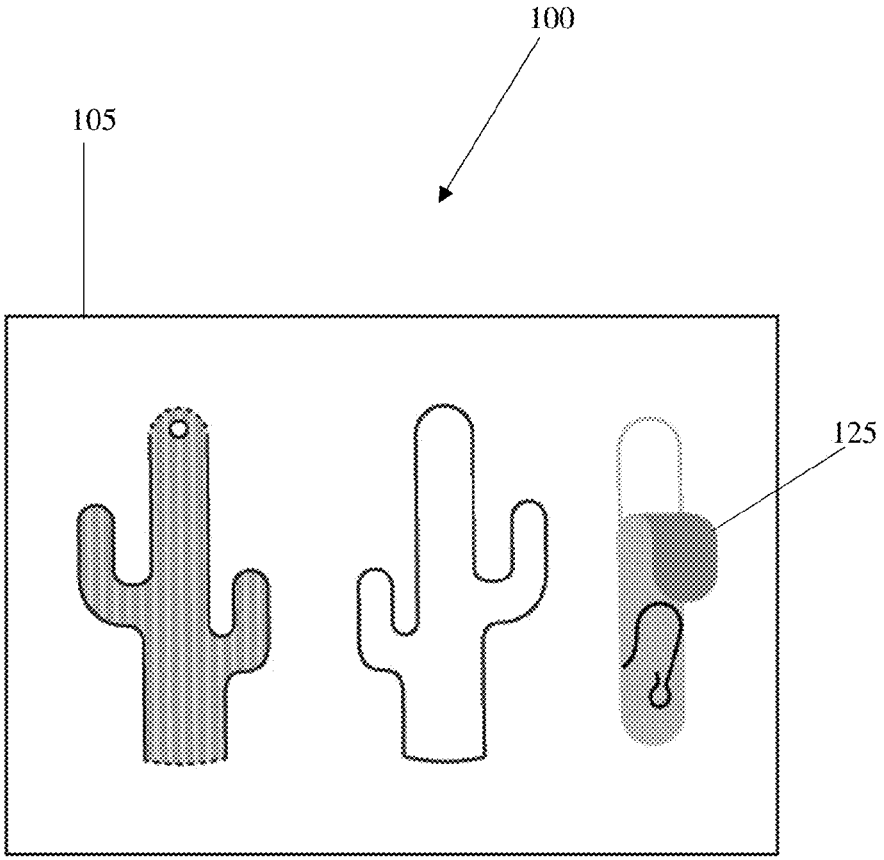
FIG. 3 is an illustration of one embodiment of the jewelry kit having one pendant separated and one earwire separated.

FIG. 3 is an illustration of one embodiment of the jewelry kit having one pendant separated and one earwire removed from the card. As shown in FIG. 3, the earwire securement strip 125 may be tearable or peelable away from the card 105, whereby the earwires 120 may be removable. As shown in FIG. 3, an earwire 120 and a pendant 110 have been removed, while one pendant 110 and earwire 120 remain attached to the card 105.

Figure 4:
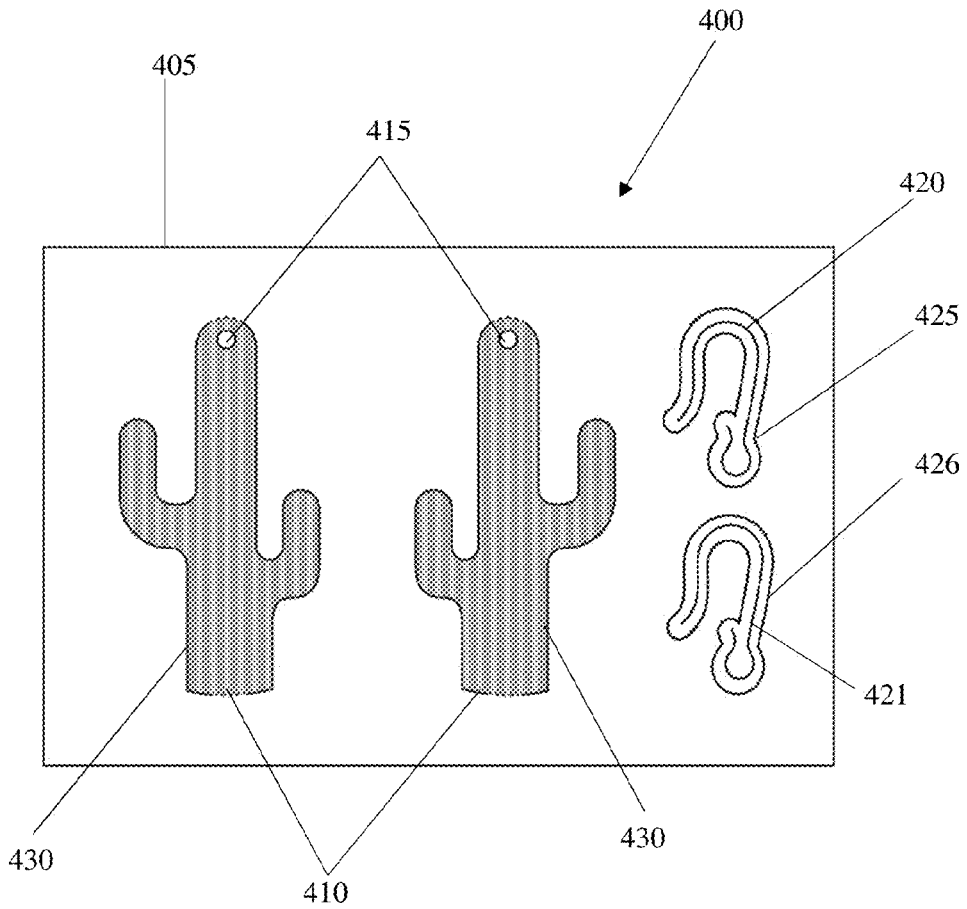
FIG. 4 is an illustration of a front view of one embodiment of the jewelry kit.

FIG. 4 is an illustration of a front view of one embodiment of the jewelry kit. As shown in FIG. 4, the jewelry kit 400 may comprise a card 405, pendants 410, pendant attachment portions 415, earwires 420, 421, pockets 425, 426, and pre-formed guides 430. The card 405 may be substantially flat, and constructed from any thin material, such as paper, cardboard, metal sheets, or other substantially flat material.

The pendants 410 may be mirror images of one another, such that when worn, the pendants 410 appear to be symmetrical. Alternatively, the pendants 410 may be identical or completely different shapes and colors, depending on the preferences of the user. The pendants 410 may be created as a result of the pre-formed guides 430. Specifically, the pre-formed guides 430 may be perforations, scores, notches, cuts, or other impressions made on the card 405. A user may then apply a pressure, such as by hand, against the pendants 410 to cause the pendants 410 to separate from the card 405 along the pre-formed guides 430. Alternatively, the pendants 410 may be torn out of the card 405 along the pre-formed guides. The pre-formed guides 430 may be created by the use of a die. The die may be a physical die, laser die, or other mechanism for scoring, tearing, perforating, or otherwise physically marking the outline of the pendants 410. Additionally, the card 405 may have a design printed onto the card 405 such that the pre-formed guides 430 demarcate a shape that also has the color or pattern of a physical object. Accordingly, the pendants 410 may be substantially any shape or design desired. As shown in FIG. 4, the pendants 410 may be cactus shaped. The pendants 410 may be identical, matching, mirror images, unique, or any other combination of shapes. The pendants 410 may comprise pendant attachment portions 415. As shown in FIG. 4, the pendant attachment portions 415 may be holes in the pendants 410 capable of receiving a hook or other ear attaching structure. One such hook or other ear attaching structure may be the earwires 420, 421.

The earwires 420, 421 may be removeably fixed to (or otherwise cradled by the card 405. The pockets 425, 426 may house the earwires 420, 421. In one embodiment, the pockets 425, 426 may have a similar shape as the earwires 420, 421, such that the earwires 420, 421 rest inside the pockets 425, 426. The pockets 425, 426 may have an adhesive or other affixing structure such that the earwires 420, 421 are removeably attached to the pockets 425, 426. The earwires 420, 421 may be a structure capable of securing a pendant 410 on one end, and securing to a user's body piercing hole on another end. FIG. 4 shows that the pockets 425, 426 are substantially the same shape as the earwires that they contain. In this manner, the earwires 420, 421 do not add a depth substantially beyond that of the card 405 and the earwires 420, 421 are matingly confined to preserve the structural integrity of the card 405.

Figure 5:
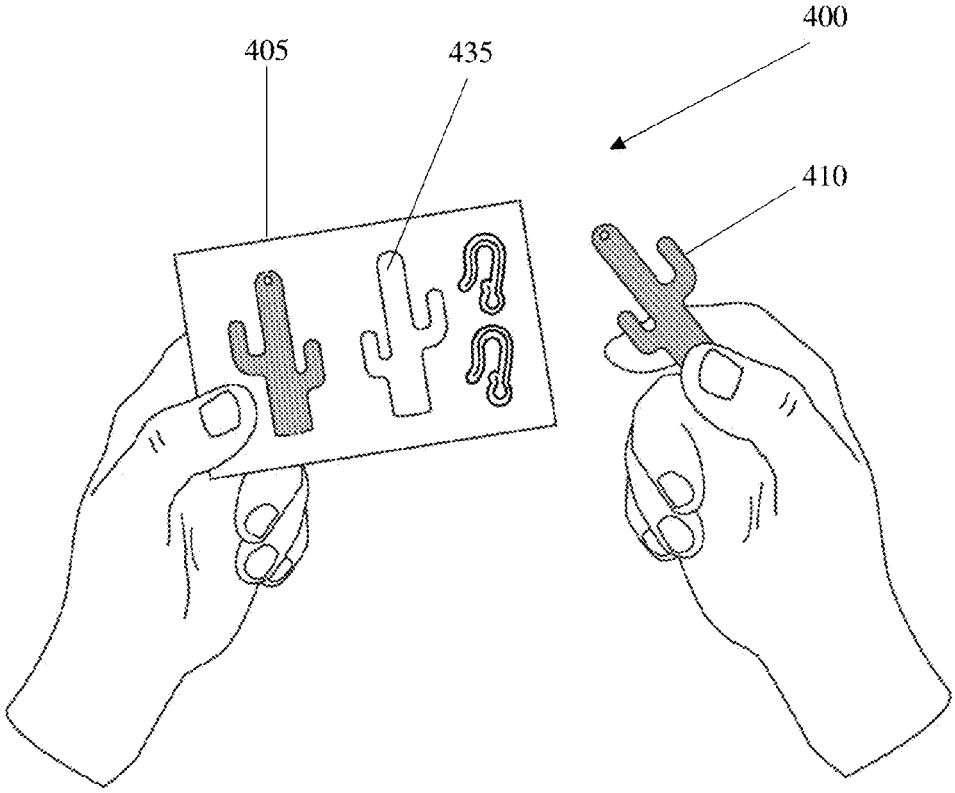
FIG. 5 is an illustration of one embodiment of the jewelry kit having one pendant separated.

FIG. 5 is an illustration of one embodiment of the jewelry kit having one pendant separated. As shown in FIG. 5, the jewelry kit 400 may have pendants 410 that are separable by hand from the card 405. After the pendant 400 has been separated, a pendant shaped hole 435 may be left in the card 405. In one embodiment of the invention, once the pendant 410 is removed from the card 405 the pendant 410 cannot be securely re-attached to the card 405. In other embodiments, the kit may be re-assembled by the user.

Figure 6:
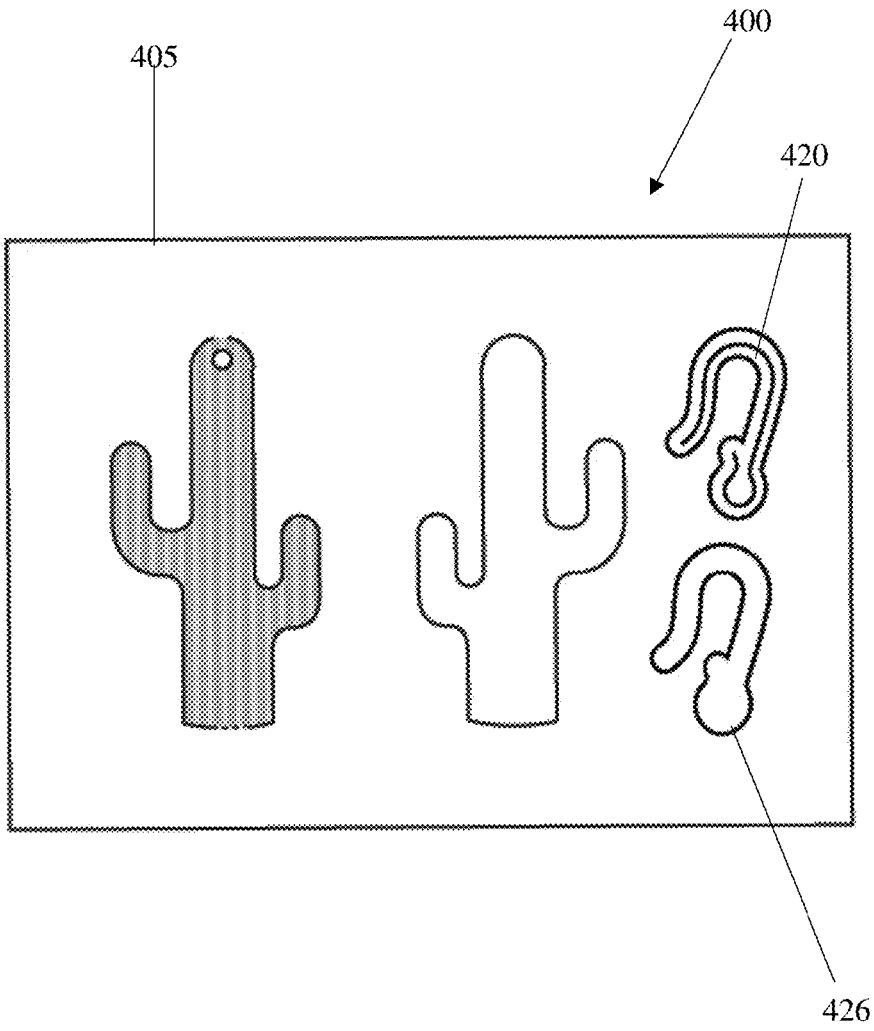
FIG. 6 is an illustration of one embodiment of the jewelry kit having one pendant separated and one earwire separated.

FIG. 6 is an illustration of one embodiment of the jewelry kit having one pendant separated and one earwire separated. As shown in FIG. 6, the earwires 421 may be removable from the pocket 426, without destroying the pocket 426. As shown in FIG. 6, an earwire 421 and a pendant 410 have been removed, while one pendant 410 and earwire 420 remain attached to the card 405.

Figure 7:
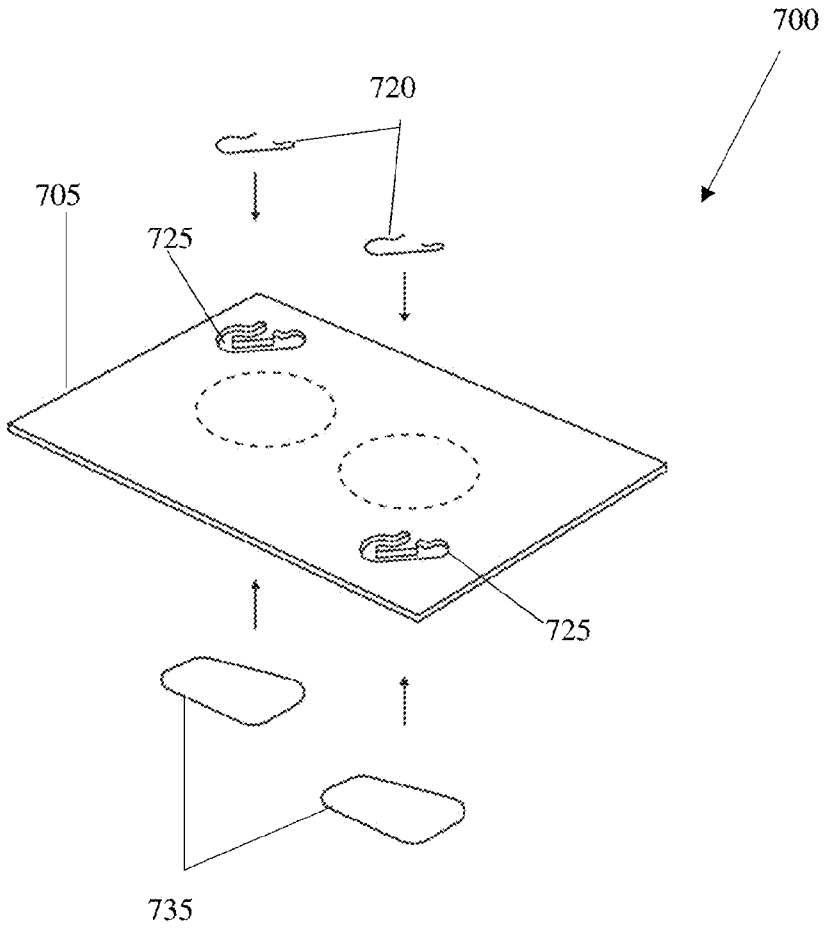
FIG. 7 is an illustration of one embodiment of the jewelry kit illustrating a securing mechanism for the earwires.

FIG. 7 is an illustration of one embodiment of the jewelry kit illustrating a securing mechanism for the earwires. As shown in FIG. 7, the jewelry kit 700 may comprise a card 705, earwires 720, apertures 725, and adhesive strips 735. The card 705 may have apertures 725 that are configured to receive the earwires 720. The apertures 725 may substantially be a hole of any shape capable of receiving the earwires 720. The adhesive strips 735 may be adhesively attached to one side of the card 705 such that the adhesive side of the adhesive strips 735 faces towards the apertures 725 such that the earwires 720 adhesively engage the adhesive strips 735 when the earwires 720 are resting in the apertures 725. Accordingly, the user may remove the earwires 720 by hand.

Figure 8:
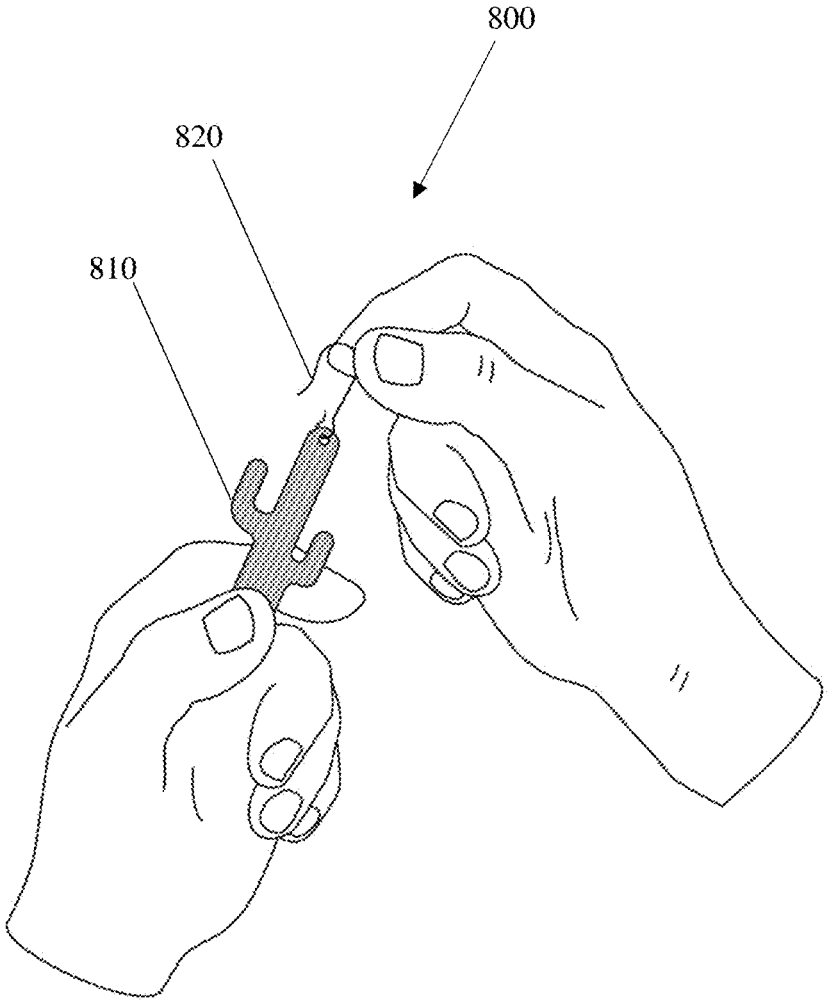
FIG. 8 is an illustration of one embodiment of an assembled earring.

FIG. 8 is an illustration of one embodiment of an assembled earring. As shown in FIG. 8, the assembled earring 800 may comprise a pendant 810 and an earwire 820.

FIGS. 9*a-c* are illustrations showing the process for assembling earrings provided in the jewelry kit. As shown in FIGS. 9*a-c*, the user may insert a lower curved portion of the earwire 920 into a pendant attachment portion 915. As shown in FIG. 9*b*, the lower curved portion of the earwire 920 may engage the pendant attachment portion 915. When the pendant attachment portion 915 initially engages the lower curved portion of the earwire 920, the earwire 920 may be biased, such that as the pendant attachment portion 915 engages the earwire 920, a portion of the earwire 920 may flex outwards to allow the pendant 910 to more easily be attached to the earwire 920. FIG. 9*c* shows the earwire 920 back to its resting state after engaging the pendant 910, which helps prevent the pendant 910 from disengaging the earwire 920. The top end of the earwire 920 may now be engaged with a pierced ear of a user. In an alternative embodiment of the jewelry kit, the circumference of the wire comprising the earwire 920 may be slightly larger than the pendant attachment portion 915, such that when engaged, the pendant 910 resists movement along the earwire 920. In this alternative embodiment, the relationship between the earwire 920 and pendant 910 may be described as comprising an interference fit or friction fit.

Unless otherwise stated, all measurements, values, ratings, positions, magnitudes, sizes, locations, and other specifications that are set forth in this specification, including in the claims that follow, are approximate, not exact. They are intended to have a reasonable range that is consistent with the functions to which they relate and with what is customary in the art to which they pertain.

The foregoing description of the preferred embodiment has been presented for the purposes of illustration and description. While multiple embodiments are disclosed, still other embodiments will become apparent to those skilled in the art from the above detailed description. These embodiments are capable of modifications in various obvious aspects, all without departing from the spirit and scope of protection. Accordingly, the detailed description is to be regarded as illustrative in nature and not restrictive. Also, although not explicitly recited, one or more embodiments may be practiced in combination or conjunction with one another. Furthermore, the reference or non-reference to a particular embodiment shall not be interpreted to limit the scope of protection. It is intended that the scope of protection not be limited by this detailed description, but by the claims and the equivalents to the claims that are appended hereto.

Except as stated immediately above, nothing that has been stated or illustrated is intended or should be interpreted to cause a dedication of any component, step, feature, object, benefit, advantage, or equivalent, to the public, regardless of whether it is or is not recited in the claims.

What is claimed is:

1. A jewelry kit, comprising:
a card; and
one or more pendants;
wherein said one or more pendants are removeably secured to said card by one or more pre-formed guides;
wherein said one or more pre-formed guides are selected from the group of guides consisting of: perforations; scoring lines; and die marks; and
wherein after said one or more pendants are removed from said card, said one or more pendants are configured to be worn by a user.

2. The jewelry kit of claim 1, wherein said card is substantially flat and rigid.

3. The jewelry kit of claim 1, wherein said one or more pendants are substantially flat and rigid.

4. The jewelry kit of claim 1, wherein said card and said one or more pendants are made of one or more materials selected from the group of materials consisting of: paper; cardboard; metal; and plastic.

5. The jewelry kit of claim 1, wherein said one or more pendants comprise one or more earwire attachment holes, wherein each of said one or more earwire attachment holes is configured to connect to at least one of said one or more earwires.

6. The jewelry kit of claim 1, further comprising:
one or more earwires;
wherein said earwires are removeably secured to said card.

7. A jewelry kit, comprising:
a card:
one or more earwires; and
one or more pendants;
wherein said one or more pendants are removeably secured to said card by one or more pre-formed guides;
wherein after said one or more pendants are removed from said card, said one or more pendants are configured to be worn by a user; and
wherein said earwires are removeably secured to said card.

8. The jewelry kit of claim 7, wherein said card comprises one or more pockets; and
wherein said one or more pockets are configured to house said earwires before said earwires are removed from said card.

9. The jewelry kit of claim 8, further comprising one or more adhesive strips that are configured to adhesively engage said earwires and removeably secure said earwires into said one or more pockets.

10. The jewelry kit of claim 7, wherein said one or more pendants comprise one or more earwire attachment holes, wherein each of said one or more earwire attachment holes is configured to connect to at least one of said one or more earwires.

11. A jewelry kit, comprising:
a card;
two pendants; and
two earwires
wherein said pendants are removeably secured to said card by one or more pre-formed guides;
wherein said card comprises two pocket's;
wherein each of said two pockets is configured to removeably secure one of said two earwires;
wherein said card and said two pendants are substantially flat and rigid;
wherein said two earwires have a thickness that is less than or equal to a thickness of said card;
wherein after said two pendants and said two earwires are removed from said card, said two pendants are configured to be connected to said two earwires and then worn by a user.

12. The jewelry kit of claim 11, wherein said card and said two pendants are made of one or more materials selected from the group of materials consisting of: paper; cardboard; metal; and plastic.

13. The jewelry kit of claim 11, wherein said one or more pre-formed guides are selected from the group of guides consisting of: perforations; scoring lines; and die marks.

14. The jewelry kit of claim 11, further comprising one or more adhesive strips that are configured to adhesively engage said earwires and removeably secure said earwires into said one or more pockets.

15. A jewelry kit comprising:
a card;
two pendants; and
two earwires
wherein said pendants are removeably secured to said card by one or more pre-formed guides;
wherein said card comprises two pockets;
wherein each of said two pockets is configured to removeably secure one of said two earwires;
wherein after said two pendants and said two earwires are removed from said card, said two pendants are configured to be connected to said two earwires and then worn by a user; and
wherein said one or more pre-formed guides are selected from the group of guides consisting of: perforations; scoring lines; and die marks.

16. A jewelry kit comprising:
a card;
two pendants;
one or more adhesive strips; and
two earwires
wherein said pendants are removeably secured to said card by one or more pre-formed guides;
wherein said card comprises two pockets;
wherein each of said two pockets is configured to removeably secure one of said two earwires;
wherein after said two pendants and said two earwires are removed from said card, said two pendants are configured to be connected to said two earwires and then worn by a user; and
wherein said one or more adhesive strips are configured to adhesively engage said earwires and removeably secure said earwires into said one or more pockets.

17. The jewelry kit of claim 16, each of said two pendants comprise one or more earwire attachment holes, wherein each of said one or more earwire attachment holes is configured to connect to at least one of said one or more earwires.

* * * * *